US009115417B2

(12) United States Patent
Barth et al.

(10) Patent No.: US 9,115,417 B2
(45) Date of Patent: Aug. 25, 2015

(54) LIQUID DROP PEENING METHOD AND APPARATUS THEREFOR

(75) Inventors: Robert A. Barth, South Windsor, CT (US); Aaron T. Nardi, East Granby, CT (US); Tahany Ibrahim El Wardany, Bloomfield, CT (US); Daniel V. Viens, Mansfield Center, CT (US)

(73) Assignee: United Technologies Corporation, Hartford, CT (US)

( * ) Notice: Subject to any disclaimer, the term of this patent is extended or adjusted under 35 U.S.C. 154(b) by 283 days.

(21) Appl. No.: 13/440,473

(22) Filed: Apr. 5, 2012

(65) Prior Publication Data

US 2013/0263635 A1 Oct. 10, 2013

(51) Int. Cl.
*C21D 7/06* (2006.01)

(52) U.S. Cl.
CPC ..... *C21D 7/06* (2013.01)

(58) Field of Classification Search
CPC ..... B21D 31/06; C21D 7/06
USPC ..... 72/53; 29/90.7
See application file for complete search history.

(56) References Cited

U.S. PATENT DOCUMENTS

| | | | | |
|---|---|---|---|---|
| 5,305,361 | A | 4/1994 | Enomoto et al. | |
| 5,778,713 | A | 7/1998 | Butler et al. | |
| 5,964,644 | A * | 10/1999 | Rhoades | 451/40 |
| 6,519,991 | B2 | 2/2003 | Hirano et al. | |
| 7,380,918 | B2 * | 6/2008 | Dean et al. | 347/82 |
| 7,513,121 | B2 | 4/2009 | Zurecki et al. | |
| 7,716,961 | B2 | 5/2010 | Hatou et al. | |
| 8,006,915 | B2 * | 8/2011 | Vijay et al. | 239/4 |
| 2011/0005288 | A1 | 1/2011 | Matsui et al. | |

* cited by examiner

*Primary Examiner* — Teresa M Ekiert
(74) *Attorney, Agent, or Firm* — Miller, Matthias & Hull LLP

(57) ABSTRACT

A method for peening a surface of a material is disclosed. The method may include producing repeated, separated and high speed liquid drops and moving the liquid drops across the surface to be peened. The liquid drops are essentially free of air bubbles and the velocity of the liquid drops is at least 500 ft/sec. A peening apparatus to produce repeated, separated and high speed liquid drops is also disclosed. The apparatus may comprise a storage tank, a nozzle, a pump, an accumulator, a regulator and an actuator. The apparatus may control the volume and velocity of the produced liquid drops as well as the frequency of the liquid drop production.

20 Claims, 4 Drawing Sheets

LIQUID DROP PEENING METHOD AND APPARATUS THEREFOR

FIELD OF THE DISCLOSURE

The present disclosure generally relates to the treatment of materials and, more particularly, relates to the peening of the surface of materials for altering the properties of the material.

BACKGROUND OF THE DISCLOSURE

The fatigue strength of materials is of importance in attaining greater capacity and in improving reliability for a device under applied loads. This is particularly true with respect to aerospace components such as turbine blades, but many other examples exist as well. Most fatigue and stress corrosion failures originate at the surface of a part. In or near a surface, residual stresses are generated after plastic deformation that is caused by applied mechanical loads, thermal loads or phase changes. Residual stresses are known to affect the initiation and the growth of fatigue cracks. In general, tensile residual stresses are undesirable since they add to applied stress levels and lead to fracture at lower loads than might be expected. Compressive residual stresses in the surface of a part are beneficial because they act against applied loads and tend to increase fatigue strength and fatigue life, slow crack propagation, and increase resistance to stress corrosion cracking.

With that in mind, in order to enhance fatigue strength and resist stress corrosion cracking in materials, compressive residual stresses have been known to be introduced into surfaces of the materials. A number of methods for doing so are known, one category of which is referred to as peening. Peening is defined as the process of altering the surface of a material by impact. A variety of peening processes have been proposed and implemented in the past. For example, shot peening is accomplished with the use of air or centrifugal propelled shot aimed to impact the surface of the material part. The shot media may be solid round objects such as spherical cast steel shot, ceramic bead, glass bead or conditioned cut wire. After the shot peening process the surface finish of a shot peened surface is not ideal and often must be carefully machined to provide close dimensional tolerance. However, this machining is done at the risk of a loss in compressive stress depth. Other difficulties include contamination, process control, and waste disposal of used shot.

Another type of peening, known as cavitation peening, is performed by creating cavitation bubbles within a water jet beam near the surface to be treated. The shock of the collapsing bubbles causes water to strike the surface of the part, plastically deforms the surface, and leads to the formation of the sought-after compressive residual stresses. Often the material part to be treated is submerged under water while a water jet is directed at the surface of interest to create cavitation bubbles. In some cases, it is deemed essential to vibrate the nozzle of the water jets in order to induce cavities in the jet stream. The requirement to submerge the material part in water is costly, inconvenient, and often not possible.

One type of water jet peening places the material part to be treated in a water tank. A high pressurized water stream with hard, round media suspended therein impinges on the surface of the material part and introduces compressive residual stresses. The media remains in the water after the completion of the process but can be strained out. Since this process requires media, it leads to higher cost and if the media is to be reused, extra steps have to be added to remove the damaged media.

Moreover, all of the above-mentioned peening processes are considered a separate step in the manufacturing process flow. As a result, they add costly manufacturing time because of the additional steps of removing the material part from the manufacturing process, moving the material part to the peening process, applying peening to the surface of the material part, removing the material part from the peening process, and sending the material part to the next manufacturing process.

Still other processes, above and beyond peening, are also known to impart compressive residual stresses on fatigue critical parts. Such processes include cold rolling, low plasticity burnishing, roller burnishing, ultrasonic peening, and laser shock peening. However, as with the above, all these processes have their incumbent benefits and detriments. For example, they can result in surface conditioning, undesirable depth of compressive stress, machine complexity and capital cost. In addition, all these processes add an additional step to the manufacturing process. Some of the above mentioned limitations have been overcome and discussed in details in U.S. patents application Nos. 13/351,380 and 13/355,831.

It would therefore be beneficial if an improved peening process for introducing compressive residual stresses were to be developed. Moreover, it would be desirable for the new process to not require removing the material part to be peened from the manufacturing process.

SUMMARY OF THE DISCLOSURE

In accordance with one aspect of the present disclosure, a method for peening materials by injecting repeated, separated liquid drops onto the surface thereof is disclosed. The method may comprise producing a volume of high pressure liquid; communicating the high pressure liquid to a nozzle; releasing the high pressure liquid from the nozzle to produce repeated, separated liquid drops, wherein the velocity of the liquid drop is at least 500 ft/sec and wherein the liquid drops are essentially free of air bubbles, and moving the liquid drops across the surface to be peened.

In accordance with another aspect of the present disclosure, a peening apparatus which injects repeated, separated liquid drops onto the surface of materials is disclosed. The peening apparatus may comprise a tank for storing a liquid; a nozzle for producing repeated separated liquid drops, wherein the velocity of the liquid drop is at least 500 ft/sec and wherein the liquid drops is essentially free of air bubbles; a pump for supplying a volume of the liquid to the nozzle; a regulator for controlling the pressure of the liquid; a high speed solenoid valve for cycling the liquid to the nozzle; and an actuator adapted to move the liquid across a surface of a material to be peened.

Further forms, embodiments, features, advantages, benefits and aspects of the present disclosure will become more readily apparent from the following drawings and descriptions provided herein.

Before proceeding with the detailed description, it is to be appreciated that the following detailed description is merely exemplary in nature and is not intended to limit the invention or the application and uses thereof. Hence, although the present disclosure is, for convenience of explanation, depicted and described as shown in certain illustrative embodiments, it will be appreciated that it can be implemented in various other types of embodiments and equivalents, and in various other systems and environments. Furthermore, there is no intention to be bound by any theory presented in the preceding background or the following detailed description.

DETAILED DESCRIPTION OF THE DISCLOSURE

Figure 1:
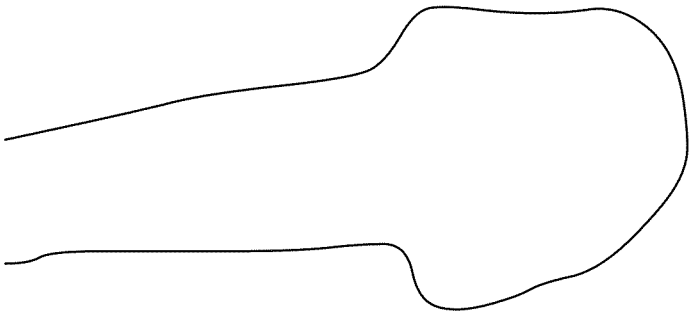
FIG. 1 is an image captured by high-speed photograph of a water droplet just before the impact on a surface.
Figure 2:
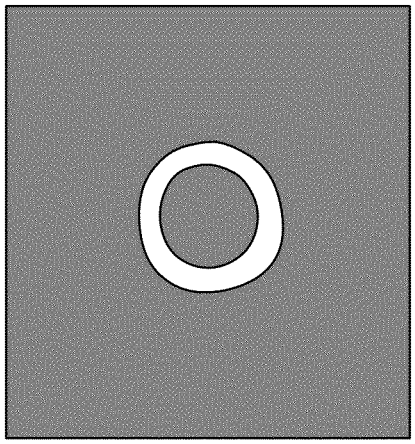
FIG. 2 is an image showing the associated damage by a liquid droplet on the surface to be peened.
Figure 3:
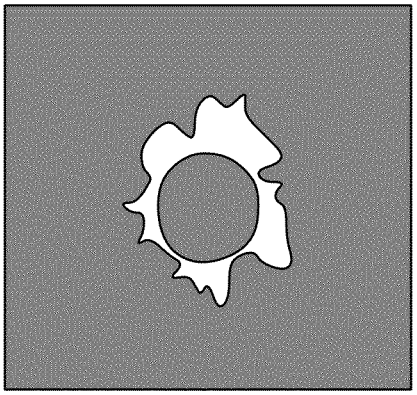
FIG. 3 shows the associated damaged by a liquid droplet on a different material to be peened.

Referring now to the drawings, and with specific reference to FIGS. 1-3, the inventors have studied the deformation of a solid when impacted by a liquid moving at extremely high speed using both high-speed photographs and other measuring equipment. They have found that, initially, plastic deformation occurs at the surface of the solid, which introduces compressive residual stresses to the surface and subsurface region. After several more shots of liquid drops, the inventors have found that cracking occurs eventually due to dislocation pile-up, coalescence and fractures. In addition, the inventors have found that an impinging liquid droplet acts like an impinging solid sphere in exerting a localized, controllable pressure. In addition, the radially flowing liquid of an impinging droplet also exerts a shear stress on the surface of the solid over which the droplets is running. From this, the inventors conceived that an impinging liquid droplet with high velocity could be used to work harden the surface of a material in a controllable manner. These findings are depicted photographically in the images of FIGS. 1-3.

Starting with FIG. 1, the photograph thereof depicts an image captured by high-speed photograph of a water droplet just before impact on a surface. FIG. 2 shows the associated damage by a liquid droplet (in this case of FIG. 2, the liquid is a permanent marker) on the surface of Lucite®, which is poly(methyl methacrylate). FIG. 3 shows the associated damaged by a liquid droplet (in the case of FIG. 3, the liquid is paint) on G11 fiberglass. As shown in FIG. 1, before impact, the water droplet looks like a mushroom where the top of the mushroom is the leading edge of the column. When the mushroom-shaped head hits the target, the water droplet collapses, causing great pressures to develop and resulting in a circular, plastically-deformed, zone on the target, as shown in FIGS. 2 and 3. During the early stages of the collision between such a liquid droplet and a planar surface of a solid, the inventors have found that maximum pressure exists in the middle of the impacting drop; however the resultant shearing effect causes a thin layer of material to plough in a ring shaped geometry around the central point of the collision. Moreover, they have found that the radius of that ring of resultant shearing increases as the value of the nozzle diameter increases. If liquid drops continuously hit the same impact spot on the surface, cracks and other damages will occur. In general, increasing the size of the liquid drop and velocity of the liquid drop will induce higher plastic deformation resulting in a higher compressive residual stress on the surface.

Figure 4:
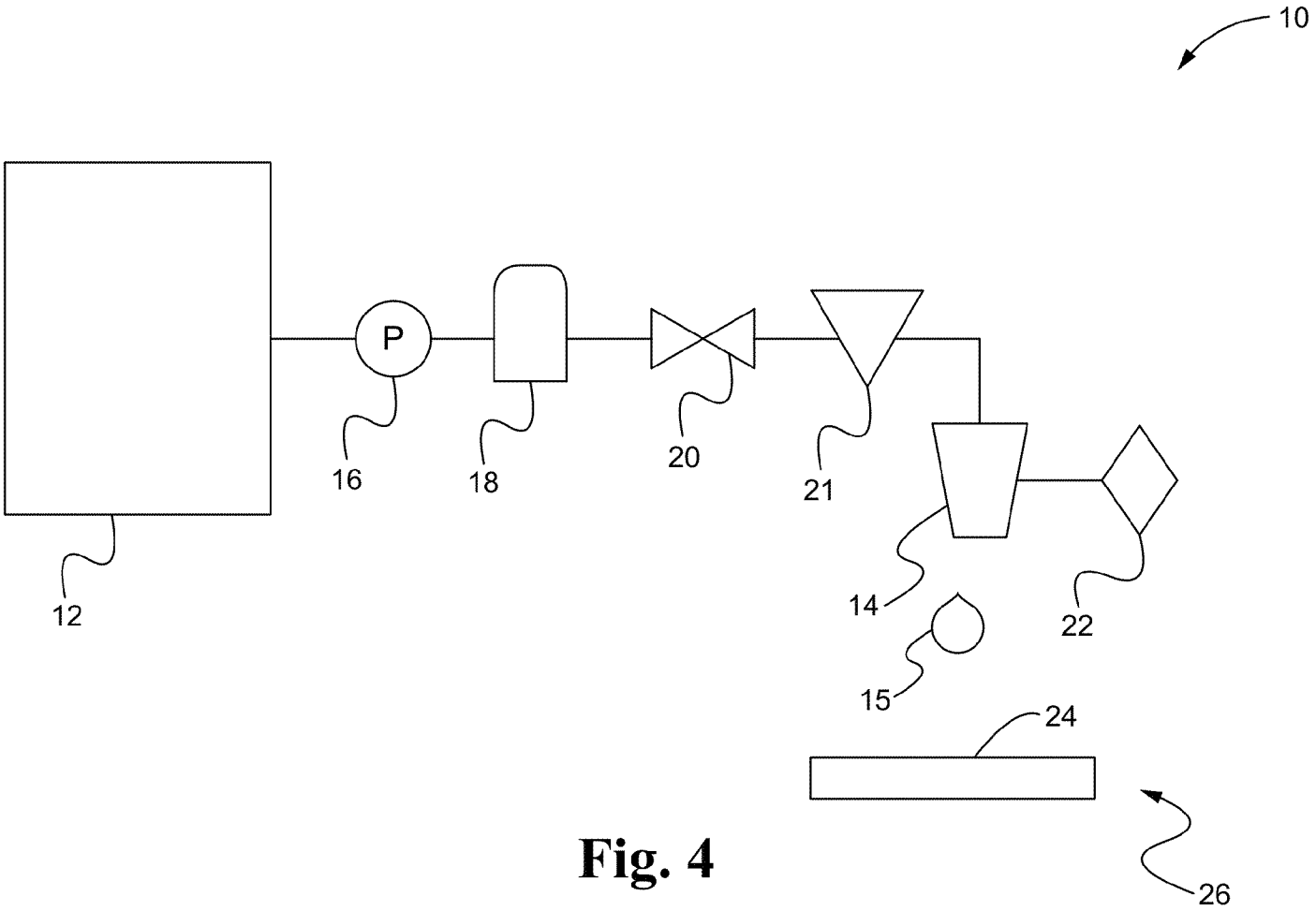
FIG. 4 is a schematic diagram showing one embodiment of a liquid drop peening apparatus constructed in accordance with the present disclosure.

In order to take advantage of these findings in the industrial machining of parts, the inventors have created the peening apparatus 10 of FIG. 4. As shown therein, the peening apparatus 10 may include a tank 12 for storing a peening liquid, a nozzle 14 for producing repeated separated liquid drops 15 of the peening liquid, a pump 16 for supplying a volume of the pressurized peening liquid to the nozzle 14, an accumulator 18 for storing the pressurized liquid; a regulator 20 for controlling the pressure of the peening liquid; a high speed solenoid valve 21 to cycle the high pressure water stream into water drops for the nozzle; and an actuator 22 for moving the nozzle 14 in a synchronized motion with the workpiece articulation inside the machine tool center, and thus peening liquid, across a surface 24 of a material or part 26 to be peened. Alternatively, the material to be peened might be moved relative to the nozzle by an actuator (not shown) inside the machine tool center.

While any number of different liquids can be used as the peening liquids, one suitable material is water. In another embodiment, the peening liquid may be a coolant, such as a coolant already used in part of a larger machine tool of which the peening apparatus is just a component part. Other liquids are certainly possible and encompassed within the scope of this disclosure.

With respect to the nozzle 14, again any number of different designs and models are possible, but the inventors have found that a nozzle 14 adapted to create a liquid drop velocity of at least 500 ft/sec and which are substantially free of air bubbles is effective. In fact, a nozzle 14 which creates a liquid drop velocity of at least 700 ft/sec may be particularly effective.

Other characteristics of the nozzle 14 and the resulting drop which are of importance are the drop diameter, drop frequency, drop length, drop volume, nozzle standoff distance, angle of drop impingement on the part surface, and drop shape. In those regards, the inventors have estimated that a drop diameter of at least 0.01 inch to 0.5 inches is suitable. Other diameters are certainly possible. With respect to frequency, a cycle of at least 6 shots/hr is effective, but other frequencies are certainly possible.

As for the length of the liquid drop, it may be no more than 0.6 inch in one embodiment, no more than 1 inch in another and no more than 2 inches in other depending on the material of the part, the peening liquid, the desired result and the other parameters mentioned herein. Similarly, with respect to volume, the volume of the liquid drop may be no more than 0.01 ml in one embodiment, no more than 0.1 ml in other, and no more than 2 ml, with other volumes certainly being possible.

The shape or movement of the drop is also of importance. In one embodiment, the liquid drops may be moved in a spiral. In another embodiment, the liquid drops may be moved along a first line, and then be moved along a second line which is adjacent to and parallel with the first line until the entire surface of the material to be peened has been peened. In a still further embodiment, the liquid drops may be moved along a first line, then along a second line which is adjacent to and parallel with the first line, then along a third line which is perpendicular to the first line, and finally along a fourth line which is adjacent to, and parallel with, the third line until the entire surface of the material to be peened has been peened.

In other embodiments, moving the liquid drops may comprise moving the center of impact caused by at least one liquid drop to an adjacent position which is at least a predetermined distance away from the previous drop. The predetermined distance may be in the range from about half the diameter of the impact area caused by an impinging liquid drop to about one full diameter of the impact area, or some other suitable dimension. In still other embodiments, the number of times a spot on the surface is hit by liquid drops is controlled in such a way that minimal surface damage occurs by excessive hitting on that spot. Liquid drops may be repeatedly applied to the same spot without indexing over based on the part material and the required induced residual stress in the surface.

Figure 5:
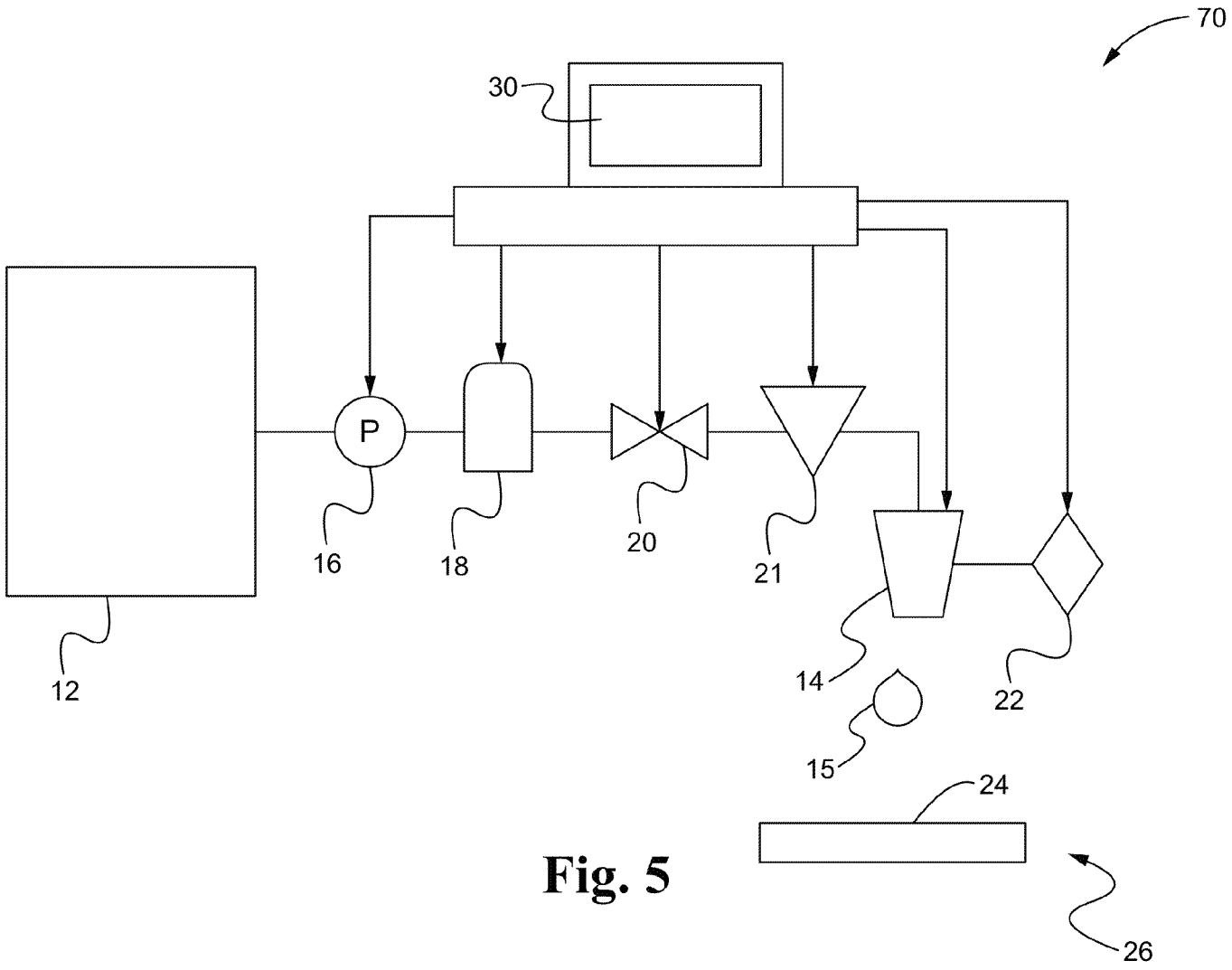
FIG. 5 is a schematic diagram showing another embodiment of a liquid drop peening apparatus constructed in accordance with the present disclosure.

Of course, the method and apparatus of the present disclosure can be automated. Referring to FIG. 5, for example, a controller or processor 30 could be employed to take command partially or entirely out of the control of a human operator and automate same. As shown in FIG. 5, an alternative peening apparatus 70 may include a tank 12 for storing a peening liquid, a nozzle 14 for producing repeated separated liquid drops 15 of the peening liquid, a pump 16 for supplying a volume of the pressurized peening liquid to the nozzle 14, an accumulator 18 for storing the pressurized liquid; a regulator 20 for controlling the pressure of the peening liquid; a high speed solenoid valve 21 to cycle the high pressure water stream into water drops for the nozzle; an actuator 22 for moving the nozzle 14 in a synchronized motion with the workpiece articulation inside the machine tool center, and thus peening liquid, across a surface 24 of a material or part 26 to be peened; and a controller or processor 30 for sending commands to and receiving feedbacks from the pump 16, the accumulator 18, the regulator 20, the high speed solenoid valve 21, the nozzle 14, and the actuator 22. Alternatively, the material to be peened might be moved relative to the nozzle by a second actuator (not shown) inside the machine tool center. The controller or processor 30 may control the operation of the second actuator. In such embodiments, the controller 30 may also control all of the aforementioned parameters including, but not limited to stand-off distance, drop velocity, drop diameter, drop length, angle of drop impingement, drop volume and drop shape or path.

Moreover, the peening apparatus 10 and 70 could be provided as part of a larger machine tool or manufacturing apparatus (not shown). In such situations, the integration of the apparatus 10 and 70 in a machining process would allow the present method of peening to be conducted during the machining process of the material without any substantially adverse effects on the other aspects of the machining process, and/or without removing the object to be peened from the machining process.

Figure 6:
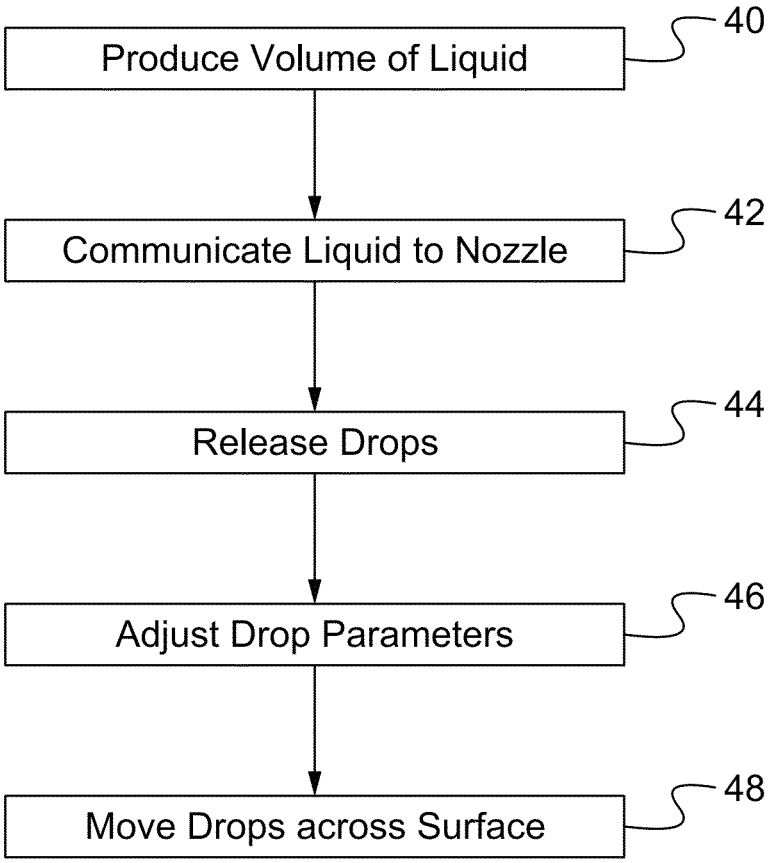
FIG. 6 is a flowchart depicting sample sequence of steps which may be practiced in accordance with a method of the present disclosure.

In operation then, the apparatus 10 and 70 disclosed above can be used to conduct a peening process as depicted in flowchart format in FIG. 6. Starting with step 40, a first step may be to produce a volume of pressurized peening liquid. A next step 42 may be to communicate that pressurized liquid to the nozzle. The pressurized liquid may then be released from the nozzle in a step 44 to produce repeated, separated liquid drops. Those drops may or may not have any or all of the aforementioned characteristics such as volume, velocity, length, frequency and shape as indicated above, and as indicated generically as step 46 in FIG. 6. A final step 48 may be to move the liquid drops across the surface to be peened by, for example, either engaging the actuator to move the nozzle relative to the workpiece or engaging the second actuator to move the workpiece relative to the nozzle. As indicated above, this may be done manually or automatically, in a stand-alone process or as part of a larger overall machining operation.

Industrial Applicability

The present disclosure is adaptable to many industrial applications including but not limited to: machining a wide variety of parts. For example, such parts may include, but not be limited to, aerospace and turbine parts manufactured from a variety of materials ranging from metals to ceramics. The disclosure provides methods to control the peening force and the hitting frequency exerted by repeated, separated liquid drops in such a way that the surface of the material is peened in a calculated manner. Moreover, the present disclosure further sets forth an apparatus which can conduct the disclosed method to peen the surface of materials in a repeatable, controlled manner.

In summary, the method and apparatus disclosed herein allow the peening of a variety of materials. The method and apparatus also allow the integration of the peening process into the machining process without either adding an additional step or removing the parts to be peened away from the machining process. Consequently, the application of the present method prevents contamination of peened surfaces as the liquid used can be easily separated from the peened material. Furthermore, the peening liquid can be collected, filtered, recycled, and reused, which is more environmental friendly and more sustainable than conventional shot peening methods. The present method also does not require submerging an object to be peened under water. Finally, the integration of the present apparatus and method into the existing machining processes reduces cost, improves efficiency and allows better control of material properties.

What is claimed is:

1. A method for peening a surface of a material, the method comprising:

producing a volume of pressurized liquid;

sending the pressurized liquid to a solenoid valve to create water drops;

sending the water drops to a converging nozzle;

releasing the water drops from the converging nozzle as separated liquid drops, wherein the velocity of the liquid drops is at least 500 ft/sec and wherein the liquid drops are essentially free of air bubbles; and moving the nozzle across the surface to be peened.

2. The method of claim 1, wherein the material to be peened is selected from a group consisting of a metal and a ceramic.

3. The method of claim 1, wherein the pressurized liquid is water.

4. The method of claim 1, wherein the velocity of the liquid drops is at least 700 ft/sec.

5. The method of claim 1, wherein the diameter of the liquid drops is at least 0.01 inch.

6. The method of claim 1, wherein the frequency of the liquid drops released from the nozzle is at least 6 drops/hr.

7. The method of claim 1, wherein moving the nozzle comprises moving the nozzle in a spiral.

8. The method of claim 1, wherein moving the nozzle comprises:

moving the nozzle along a first line; and moving the nozzle along a second line which is adjacent to and parallel with the first line.

9. The method of claim 8, further comprising:

moving the nozzle along a third line which is perpendicular to the first line; and moving the nozzle along a fourth line which is adjacent to and parallel with the third line.

10. The method of claim 1, wherein moving the nozzle comprises moving the material to be peened relative to the nozzle.

11. A peening apparatus comprising:

a tank;

a pump fluidically coupled to and downstream of the tank;

a regulator fluidically coupled to and downstream of the pump;

a solenoid valve that actuably creates water drops fluidically coupled to and downstream of the regulator;

a converging nozzle fluidically coupled to and downstream of the solenoid valve, the converging nozzle releasing, separated liquid drops, wherein the velocity of the liquid drops is at least 500 ft/sec and wherein the liquid drops are essentially free of air bubbles;

an accumulator for storing the liquid downstream of the pump; and an actuator coupled with the converging nozzle and adapted to move the converging nozzle across a surface of a material to be peened.

12. The apparatus of claim 11, wherein the velocity of the liquid drops is at least 700 ft/sec.

13. The apparatus of claim 11, wherein the diameter of the liquid drops is at least 0.01 inch.

14. The apparatus of claim 11, wherein frequency of the liquid drops produced from the nozzle is at least 6 drops/hr.

15. The apparatus of claim 11, wherein the actuator moves the nozzle in a spiral.

16. The apparatus of claim 11, wherein the actuator is adapted to move the nozzle along a first line and is further adapted to move the nozzle along a second line which is adjacent to the first line.

17. The apparatus of claim 16, wherein the actuator is adapted to move the nozzle along a third line which is perpendicular to the first line and is further adapted to move the nozzle along a second line which is adjacent to the first line.

18. The apparatus of claim 11, wherein the apparatus is part of a larger machine tool.

19. The apparatus of claim 11, wherein the material being peened is an aerospace component.

20. The apparatus of claim 11, further including a processor adapted to automate the peening process.

* * * * *